United States Patent [19]

Shenoha et al.

[11] 4,318,340

[45] Mar. 9, 1982

[54] VARIABLE TAPE ADVANCE IMPRINT MARKER

[75] Inventors: James L. Shenoha, Lockport; Robert A. Burch, Chicago, both of Ill.

[73] Assignee: Norwood Marking & Equipment Co., Inc., Downers Grove, Ill.

[21] Appl. No.: 104,380

[22] Filed: Dec. 17, 1979

[51] Int. Cl.[3] ..... B41F 1/04

[52] U.S. Cl. ..... 101/27; 101/41; 101/298

[58] Field of Search ..... 101/27, 10, 41, 288, 101/298

[56] References Cited

U.S. PATENT DOCUMENTS

| | | | |
|---|---|---|---|
| 1,909,844 | 5/1933 | Brenner | 101/27 |
| 2,035,957 | 3/1936 | Gabrielsen | 101/27 |
| 3,120,177 | 2/1964 | Clark | 101/41 |
| 3,304,856 | 2/1967 | Birch | 101/27 |
| 3,418,924 | 12/1968 | Kingsley | 101/27 |
| 3,878,776 | 4/1975 | Schneider | 101/27 |
| 3,902,409 | 9/1975 | Filsinger | 101/27 |
| 4,044,676 | 8/1977 | Hudson | 101/27 |
| 4,048,913 | 9/1977 | Navi | 101/27 |
| 4,121,520 | 10/1978 | Shenoha | 101/41 |

*Primary Examiner*—William Pieprz

*Attorney, Agent, or Firm*—Hill, Van Santen, Steadman, Chiara & Simpson

[57] ABSTRACT

A continuous motion ribbon imprinter moves with and marks a moving web on a packaging machine and has an easily set control adjusting step-by-step advance of the ribbon across the type block to accommodate wide variations in the size of the printed indicia so as to always present just enough length of fresh ribbon to cover the type for the next imprint. A frame mounting the type block and ribbon reels swings in either a clockwise or counterclockwise orbital path having a dwell stroke on the moving web, and a lift stroke spacing the ribbon from the web. The ribbon remains stationary on the type block during the dwell stroke and is advanced across the type block on the lift stroke. A single input shaft drives the frame through its orbital path and also drives the mechanism for unwinding the fresh ribbon from one reel and winding the spent ribbon on a second reel. The control includes an adjustable cross head driving a link which in turn drives a feed roll mechanism through a one way clutch pulling the needed length of ribbon from the unwinding reel during the lift stroke. The winding reel is driven through a slip mechanism which maintains the ribbon under tension and winds the spent ribbon on the winding reel as it is pulled step-by-step by the feed roll mechanism.

9 Claims, 10 Drawing Figures

FIG. 1
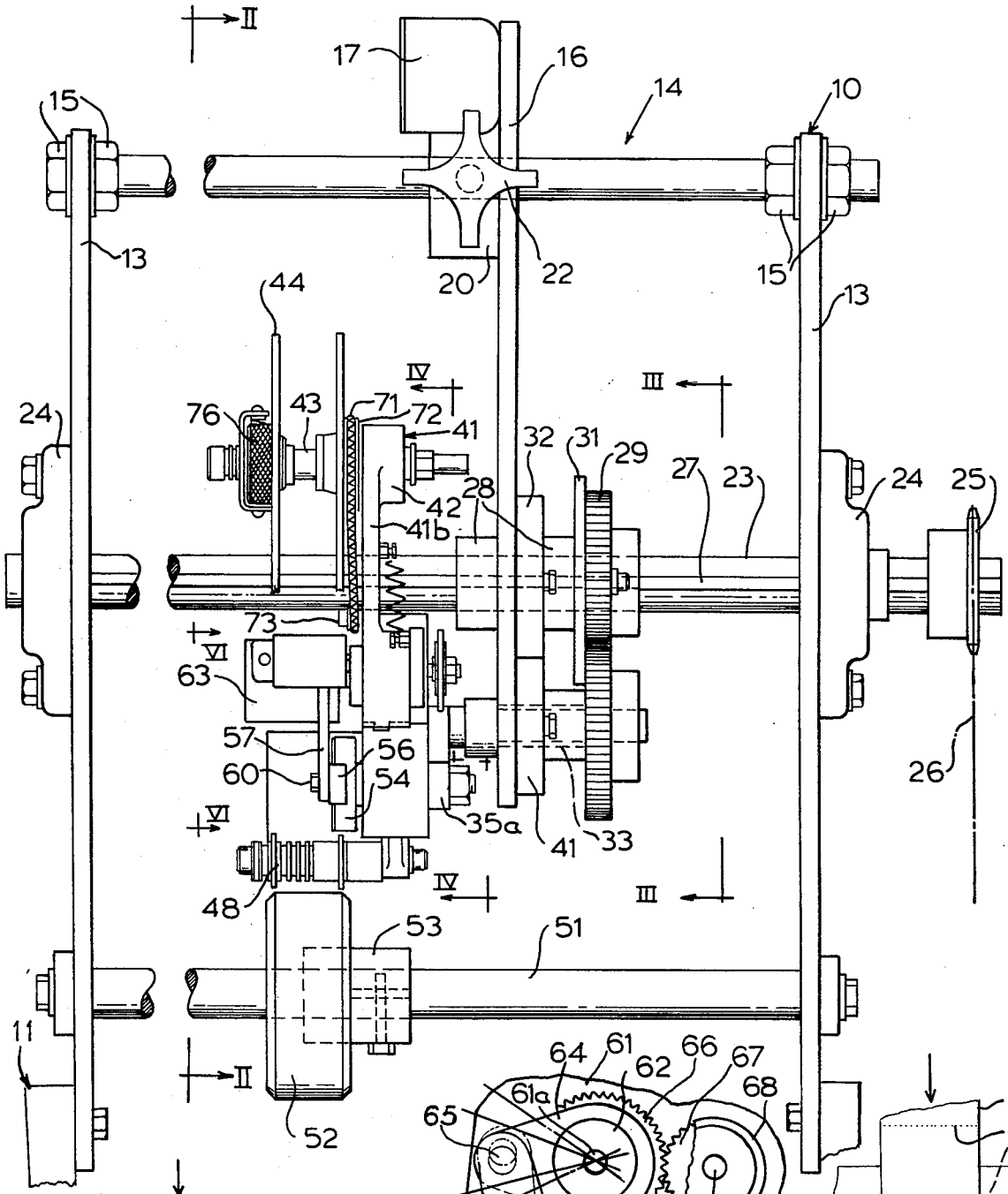
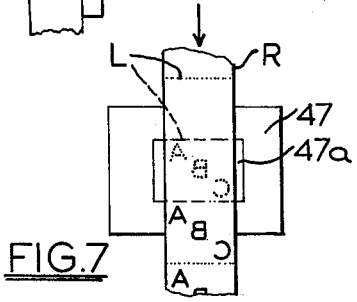
FIG.7
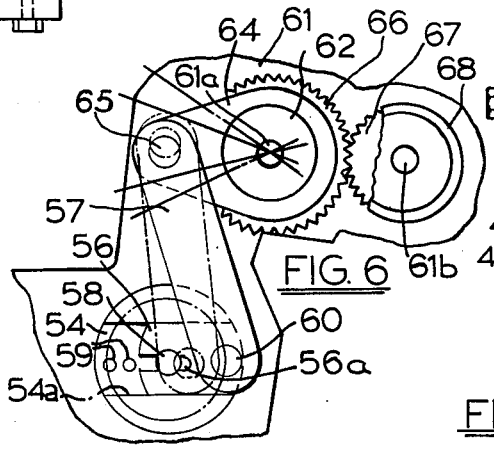
FIG. 6
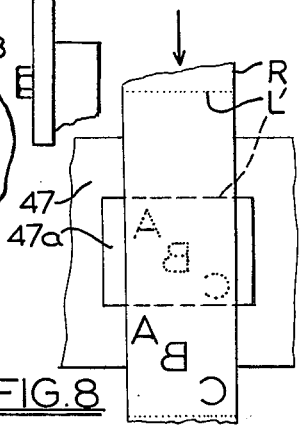
FIG.8

VARIABLE TAPE ADVANCE IMPRINT MARKER

BACKGROUND OF THE INVENTION

1. Field of the Invention

This invention relates to imprinters for packaging machines and the like and particularly deals with a control driven by a continuous motion ribbon imprinter which is easily set to supply just enough length of fresh ribbon to cover the type without wasting unused ribbon increments between imprints.

2. Description of the Prior Art

Heretofore ribbon imprinters capable of handling printing blocks of variable sizes have been intermittently operated with controlled ribbon advancement occurring only during stationary periods. Continuous motion ribbon imprinters have not been able to accommodate wide variations in sizes of printing blocks without complicated change-over ribbon drives for each block size.

It would therefore be an advance in the art to provide continuous motion ribbon imprinters accommodating a wide range of printing block sizes and having an easily adjusted control to supply just the right increment length to the selected printing block for each imprint.

SUMMARY OF THE INVENTION

Continuous motion ribbon imprinters are now provided with variable ribbon feeds driven from the power input of the imprinter. These ribbon feeds or drives swing with the imprinter frame through an orbital path and pull selected length increments of pigmented ribbon or tape from an unwinding roll during the backward lift stroke of the orbiting frame to cover just the type or imprint area of the printing block with enough fresh tape to insure a good type imprint during the dwell stroke when the ribbon and printing block advance with the moving web being printed. The feed drive is easily set so that no unused tape length increments will occur.

A feature of the invention includes the continuous driving of the ribbon feed from the power input to the imprinter and the selective use of the continuous drive to intermittently advance just enough ribbon length between imprints to supply the printing area of the type block. No change-over parts are needed since the ribbon advances just enough to meet the requirements of many different sizes of printing area. Thus the imprinter accommodates printing blocks with widely variable printing areas without wasting imprint ribbon betweem imprints.

An object of the invention, therefore, is to provide continuous motion ribbon imprinters with ribbon drives that are easily set to accommodate printing blocks with widely variable printing areas without wasting ribbon between imprints.

A further object of the invention is to provide a ribbon feed on a continuous motion ribbon imprinter which swings through an orbital path with the imprinter and selectively advances just enough ribbon length over the printing block to cover the printing area thereof with fresh ribbon between imprints.

A specific object of the invention is to provide a continuous motion ribbon imprinter with a rotary drive driven from the power imput of the imprinter and in turn driving a link through a selectively positioned cross head to drive a one way clutch feed roll mechanism to pull selected increments of pigmented ribbon from an unwinding reel.

Another specific object of the invention is to provide a continuous motion ribbon imprinter supplying pigmented ribbon over the face of the printing block from an unwinding reel and winding spent ribbon on a winding reel driven from the power imput of the imprinter and quickly and easily adjusted to vary the feed increment of the ribbon as required by variations in the printing areas of type blocks mounted on the imprinter.

Other and further objects of this invention will become apparent to those skilled in this art from the following detailed description of the annexed sheets of drawings which, by way of a preferred example only illustrate one embodiment of this invention.

On the drawings:

FIG. 1 is a broken end view of a continuous motion ribbon imprinter of this invention.

FIG. 6 is a fragmentary elevational detail view along the line VI—VI of FIG. 1 and showing in dotted lines an adjusted position of the feed roll drive.

FIG. 7 is a diagrammatic fragmentary bottom plan view illustrating ribbon increment advancement for a small print area.

FIG. 8 is a view similar to FIG. 7 but showing ribbon increment advancement for a larger print area.

AS SHOWN ON THE DRAWINGS

Figures 2, 5:
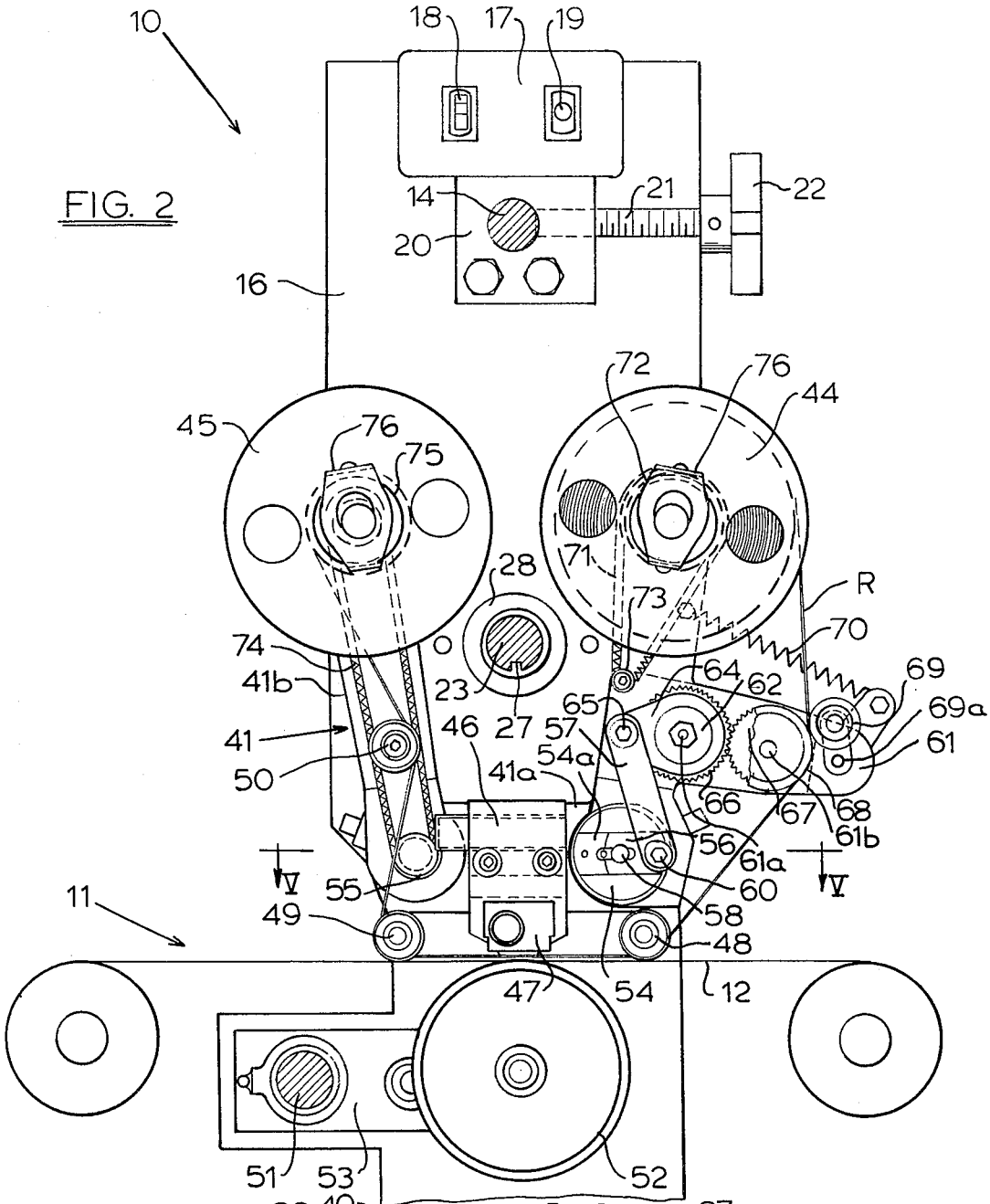
FIG. 2 is a vertical cross sectional view with parts in side elevation, of the imprinter of FIG. 1 taken along with the line II—II of FIG. 1.
FIG. 5 is a fragmentary cross sectional view along the line V—V of FIG. 2.

In FIGS. 1 to 4, the continuous motion ribbon imprinter 10 of this invention is illustrated as being mounted upright on a packaging machine 11 to extend transversely across the horizontal run of a web 12 on the packaging machine to imprint indicia on the web 12 at selected successive areas of the web as it moves through the machine. The packaging machine is only exemplary illustrated since the imprinter of this invention is useful on moving web type packing machines in general.

The imprinter 10 has a mounting rack with a pair of transversely spaced upright frame side columns 13, 13 which can be attached in any suitable manner to the frame of the packaging machine 11. The top ends of the side columns 13, 13 support a rod 14 spanning the space between the columns and threaded to be clamped to the columns by nuts 15. A frame plate 16 is mounted upright between the columns 13, 13 and receives the rod 14 freely therethrough.

The plate 16 projects above the rod 14 and carries at its upper end an electrical junction box 17 with an on-off switch 18 and an indicator light 19 (FIG. 2) for a purpose hereinafter to be more fully described. Immediately below the junction box 17 the frame plate 16 carries a bushing block 20 to slideably support the rod 14 and also mounting the threaded stem 21 of a hand wheel or knob 22 which can be rotated to press the end of the stem against the rod 14 thereby locking the plate in fixed adjusted position on the rod.

Figure 3:
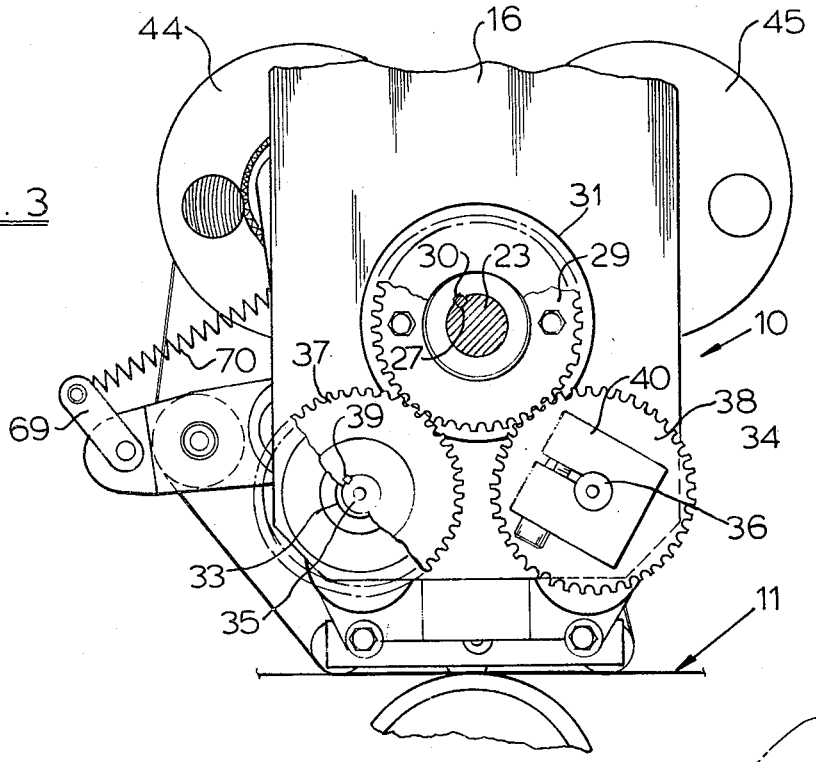
FIG. 3 is a fragmentary vertical cross sectional view taken along the line III—III of FIG. 1.

A drive shaft 23 spans the space between the columns 13, 13 in spaced relation below the rod 14 and is rotatably mounted in bearings 24, 24 carried by the columns. The drive shaft is driven from a sprocket 25 (FIG. 1) which in turn is driven from a sprocket chain 26 connected to a drive sprocket on the packaging machine 12 (not shown). This drive shaft 23 has a keyway 27 along the length thereof. A bushing 28 on the plate slideably rides on the drive shaft and a gear 29 alongside the bushing is keyed to the shaft by a key 30 fitting the keyway 27 (FIG. 3). This gear 29 is bolted to a disk 31 held against the bushing 28 as will be more fully hereinafter described. The bushing 28 is lubricated from a bearing block 32.

The lower end of the plate 16 carries a pair of bushings 33 and 34 rotatably supporting shafts 35 and 36 on which are mounted gears 37 and 38 driven by the gear 29. The gear 37 is keyed to its shaft by a key 39 while the gear 38 is clamped to its shaft 36 by a clamp block 40 permitting easy setting of the shaft position in the gear. The shafts 35 and 36 are journaled in the bushings 33 and 34 so that they will move with the plate 16 and the disk 31 bolted to the gear 29 in abutting the back faces of these gears 37 and 38 will move with the gears as the plate 16 is shifted across the space between the columns 13,13. Bearing blocks 41 similar to the block 32 lubricate the bushings 33 and 34.

Figure 4:
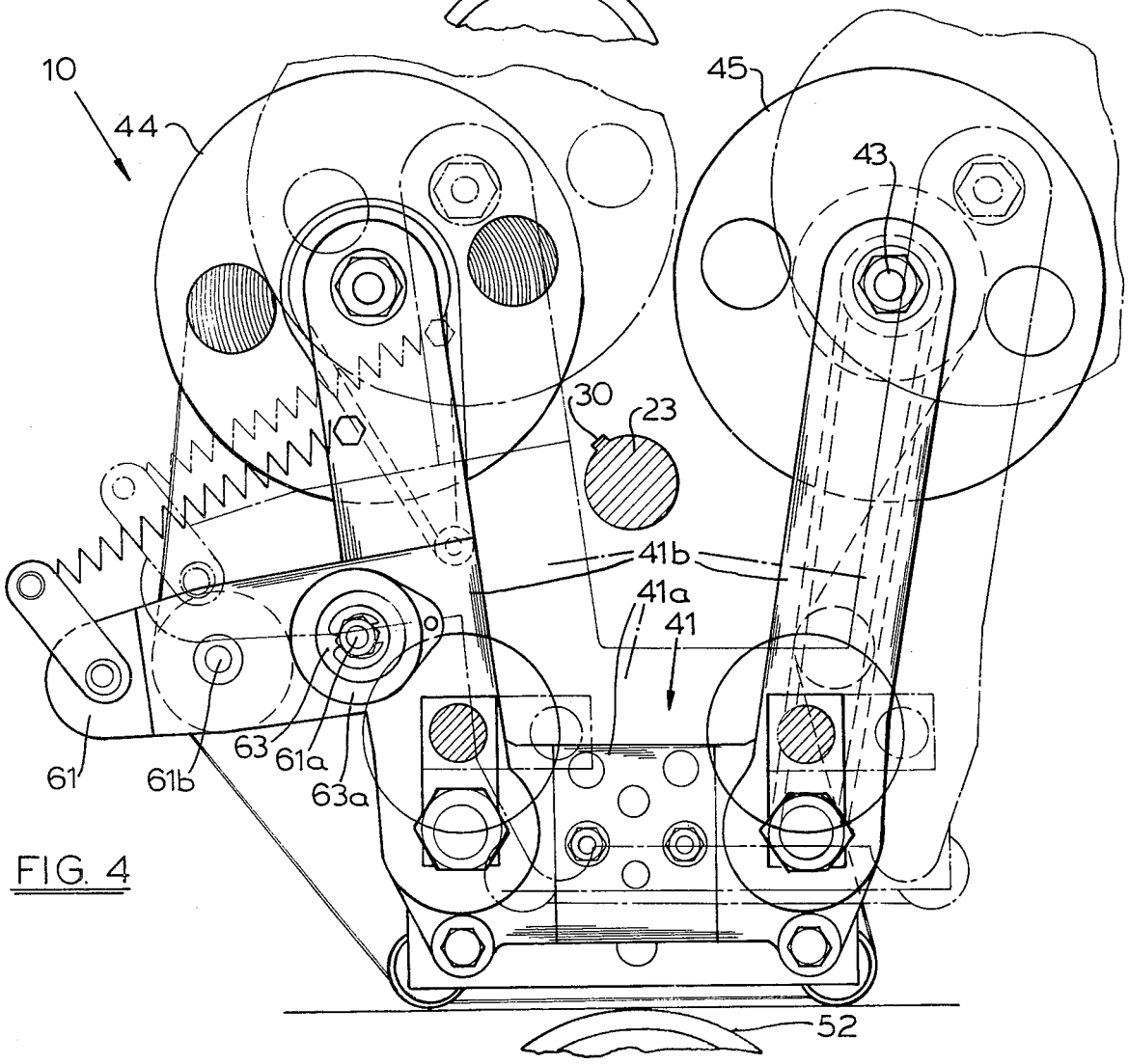
FIG. 4 is a fragmentary vertical cross sectional view taken along the line IV—IV of FIG. 1 and showing in dotted lines the orbital path of the printing block and reel frame.

As shown in FIG. 5, the shafts 35 and 36 driven by the gears 37 and 38 have crank arms 35*a* and 36*a* on the side of the plate opposite the gears supporting a saddle frame 41 of U shape as shown in FIGS. 2 and 4. These crank arms rotate in the bight portion 41*a* of the bottom of the U shape saddle while upstanding arms 41*b* straddle the drive shaft 23 and have bearing bushings 42 (FIG. 1) at their upper ends respectively mounting shafts 43 for an unwinding reel 44 and a winding reel 45 (FIG. 2).

The bottom bight portion 41*a* of the U shape saddle frame 41 carries a heater block 46 having a bottom groove receiving a removeable print block 47 (FIG. 1). The heater block 46 is heated from electrical current supplied through the above referred to journal box 17 with the indicator light 19 thereof showing the heated condition of the block. This heater block 46 serves to heat the print block and the raised type thereon to a temperature which is sufficient to melt and transfer the pigment of the ribbon to the traveling web 12 of the packaging machine as will be more fully hereinafter described.

Ribbon guide rolls 48 and 49 on the bottom 41*a* of the saddle frame 41 direct a run of the ribbon R under the type block 47 just above the horizontal run of the web 12 on the packaging machine 11. A guide roll 50 on the arm 41*b* of the U shape saddle frame supporting the winding reel 45 receives the ribbon from the roll 49 to direct it to the winding reel 45.

The side columns 13, 13 also carry a rod 51 spanning the space therebetween and mounting a back-up roll 52 on an arm 53 clamped to the rod 51. The back-up roll is selectively positioned along the length of the rod 51 to directly underlie the printing block 47.

The crank arms 35*a* and 36*b* have shaft portions 35*b* and 36*b* rotatably mounted in bearings 33*a* and 34*a* in the bight 41*a* of the saddle frame 41 so that when the gears 37 and 38 are driven, the entire saddle frame 41 will swing through an orbital path as designated in dotted lines in FIG. 4, moving the saddle frame and all of its components forwardly through a lowered dwell stroke where the type on the printing block 47 is pressed against the web 12 and then upwardly and rearwardly through a lift stroke where the type block and the ribbon are spaced above the web. The arrangement is such that the orbital movement of the frame 41 with its components is continuous and timed to move forward on its dwell stroke with the web 12 during the imprinting formed by the pressing of the heating type on the bottom run of the ribbon between the guide rolls 48 and 49 against the web 12 when backed by the backing roll 52 which may have a resilent cover.

Figure 9:
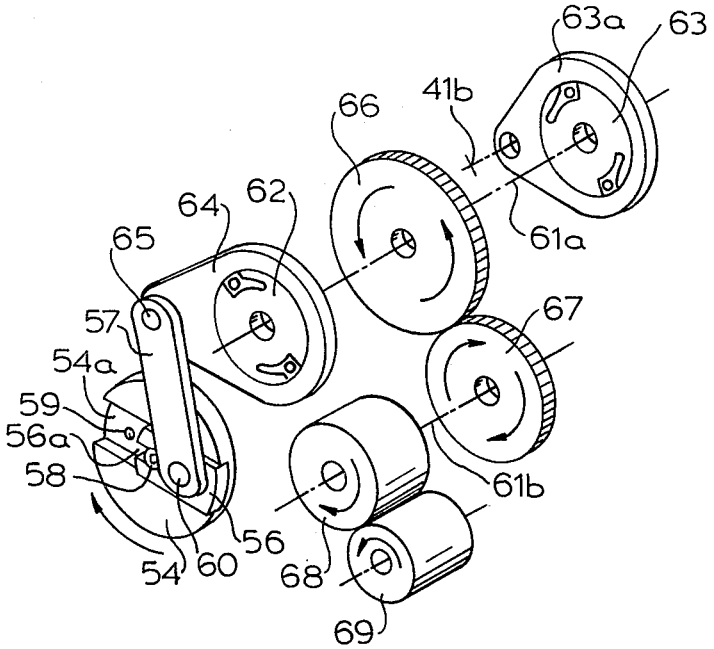
FIGS. 9 and 10 are diagrammatic perspective views of the feed roll drive showing how it will pull the ribbon in the same direction for both clockwise and counterclockwise orbiting imprinters.
Figure 10:
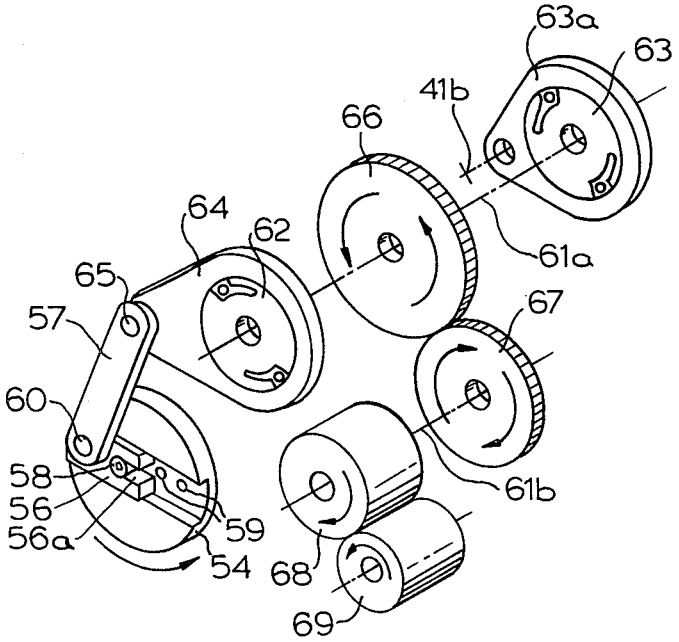

The shaft portion 35*b* of the shaft 35 has a drive wheel 54 secured thereon while the shaft portion 36*b* of the shaft 36 has a second drive wheel 55 secured thereon. The wheel 54 has a slot 54*a* extending diametrically thereacross which slideably supports a block 56 on which is pivoted a link 57. The block 56 has an elongated slot 56*a* receiving a headed pin 58 threaded into the wheel which can be tightened to lock the block in fixed selected positions in the slot 54*a*. As shown in FIGS. 6, 9, and 10, this pin 58 can be selectively threaded into longitudinally spaced threaded holes 59 in the bottom of the groove 54*a* to provide for extended positioning of the block relative to the center of rotation of the drive wheel 54.

As also shown in FIGS. 6, 9, and 10, the link 57 is pinned at 60 to one end of the block 56 and the throw of the link will be determined by the length of the radius arm between this pin and the center of rotation of the drive wheel 54. Therefore, the sliding of block 56 to position the pin 60 at variable distances from the center of rotation of the drive wheel 54 will vary the stroke of the link.

As shown in FIGS. 2 and 4, the arm 41*b* of the saddle frame 41 carrying the unwinding reel 44 has a lateral extension 61 carrying shafts or pins 61*a* and 61*b*. A first one way clutch 62 driven in a counterclockwise direction and a second one way clutch 63, acting as an anti back-up lock preventing clockwise rotation, are mounted on the shaft 61*a*. The clutch 63 is anchored to the arm 41*b* through an arm 63*a* (see FIGS. 9 and 10). Any of the known one way clutches are useful. The clutch 62 is driven by a crank arm 64 pinned at 65 to the upper end of the link 57. The arrangement is such that the clutch 62 will be driven only on the downstroke of the link to drive a gear 66 (FIGS. 9 and 10) in a counterclockwise direction. This gear 66 is meshed with a gear 67 on the shaft 61*b* so that this gear 67 is driven in a clockwise direction. The gear 67 in turn drives a feed roll 68 in a clockwise direction.

A back-up idler roller 69 is carried on a crank arm 69*a* pivoted on the arm 61 and biased by a spring 70 to press the ribbon R from the unwinding reel 44 against the feed roll 68 to form a nip therewith so that when the roll 68 is driven, the ribbon R will be pulled from the unwinding reel in a length increment determined by the driving stroke of the link 57 which, as pointed out above, in turn, is determined by the position of the block 56 in the groove 54*a* of the driving wheel 54.

As shown by FIGS. 9 and 10, the drive wheel 54 can be driven either clockwise in FIG. 9 or counterclockwise in FIG. 10 to pull the link 57 downwardly for oscillating the arm 64 and engaging the clutch 62 to drive the gear 66 in a counterclockwise direction. On the upstroke of the link 57 and arm 64, the clutch 62 disconnects and the clutch 63 locks to prevent reverse rotation of the gear 66. Thus, the input shaft 23 may be driven in either direction to orbit the saddle frame 41 clockwise or counterclockwise and the feed roll 68 will always be driven in one direction (clockwise as shown ) to pull the ribbon from the unwinding reel 44.

A coil spring belt 71 trained around a pulley 72 on the unwinding reel 44 and around a fixed pin 73 projecting from the arm 41*b* of the frame 41 acts as a brake holding the reel against rotation and offering resistance to maintain a taut run of the ribbon R between the reel and the driving nip.

The drive wheel 55 driven from the shaft portion 36*b* is grooved and receives a coil spring belt 74 stretched around a pulley 75 on the winding reel 45 so as to exert a continuous driving action to wind up the spent or used ribbon on the reel 45. The arrangement is such that the coil spring driving belt 74 will slip, permitting the reel 45 to stay stationary until such time as the feed mechanism rotates the feed roll 63 to pull an increment of tape from the unwinding reel 44 whereby the run of the ribbon from the feed mechanism is always maintained in a taut position.

Quick disconnect clamps 76 are provided for the outer plates of the reels 44 and 45 to accommodate quick mounting of ribbons of desired widths. The guide rolls, such as 48, are also adjustable in width by the use of spacer washers and the like shown in FIG. 1 to accommodate tapes of different widths.

From the above descriptions it will be understood that the drive shaft 23 is continuously driven from the sprocket connection to the packaging machine 11 in exact timed relation to the movement of the web 12 through the machine. The main frame plate 16 of the imprinter and the back-up wheel 52 are adjusted on their support rods 14 and 51 to position the printing block and back-up roll transversely of the packaging machine so that the imprint will be made at the exact location selected for the web 12 passing through the machine.

The stroke of the feed mechanism is regulated by positioning the block 56 in the slotted groove 54*a* of the drive wheel 54 to feed the ribbon R in increment lengths just sufficient to accommodate the printing area. Thus as shown in FIG. 7, when the printing area 47*a* of the printing block 47 is relatively small, a narrow ribbon R may be used to pass under the printing area 47*a* and provide just sufficient width to cover the printing indicia. The stroke of the feed mechanism is controlled so that the length increments of ribbon R illustrated by the dotted lines L will be just sufficient to cover the indicia on the printing area. Then, when printing block 47 is replaced with a larger block as shown in FIG. 8, a wider ribbon can be threaded on the imprinter to just cover the printing indicia and the stroke of the feed mechanism regulated to advance longer length increments L′ over the printing block.

It should be understood, therefore, that the imprinters of this invention are driven continuously from the machine on which they are mounted, move with the work product being printed and are easily adjusted to advance just enough length of pigmented ribbon during a return stroke to accommodate the next imprint. The ribbons carry a thermoplastic pigment which is printed onto the work product by heated type pressed against the ribbon which in turn is pressed against the work product as it advances through the packaging machine or the like.

It will, of course, be understood that modifications and departures from the specifically illustrated embodiment of this invention may be made without departing from the scope of the invention as defined in the herein presented claims.

We claim as our invention:

1. An imprinter comprising a support rack, a main frame suspended from said rack movable across the rack, a drive shaft rotatably journaled in said rack extended freely through said main frame and adapted to be rotated in either direction from a packaging machine or the like, a drive gear slidably keyed on said drive shaft, a pair of gears journaled on said main frame meshed with said drive gear, an upstanding U-shaped frame straddling said drive shaft adjacent to said main frame, bell cranks driven by said pair of gears driving said U-shaped frame in an orbital path with a lowered stroke and a raised stroke having a direction controlled by the direction of rotation of the drive shaft, a ribbon unwinding reel rotatably mounted on one side leg of the U-shaped frame, a ribbon winding reel rotatably mounted on the other leg of said U-shaped frame, a heater mounted on the bight portion of said U-shaped frame, a type block removably mounted on said heater, guide rolls on the U-shaped frame directing ribbon from the unwinding reel over the type block to the winding reel, a feed mechanism driven in one direction by one of said bell cranks for pulling ribbon from said unwinding reel as the U-shaped frame moves through its raised stroke in its orbital path, adjustable means for maintaining said one direction of drive input to the feed mechanism in either direction of rotation of the drive shaft varying the drive input to said feed mechanism for regulating the increment length of ribbon pulled from the unwinding reel during said raised stroke of the U-shaped frame, and means driven by another of said bell cranks driving said winding reel to maintain the ribbon in a taut condition, said adjustable means including a driven rotating member having a slot therein extending to both sides of a center point of rotation of the member, a slidable block in said slot, fastening means for fastening the slidable block in a selected one of a number of positions in the slot on both sides of the center point, and a link connection between said slidable block and said feed mechanism having a single direction drive stroke controlled by the position of said slidable block in said slot.

2. The imprinter of claim 1, wherein the slot extending to both sides of the center point of the driven rotating member has a plurality of longitudinally spaced fastener receptacles and the fastening means for fastening the slidable block is a pin secured in a selected one of said receptacles.

3. The imprinter of claim 2, wherein the slidable block has a slot receiving said pin, accommodating additional adjustment of said block in the slot of the rotating member and the pin clamps said block in said slot.

4. A continuous motion imprinter of the type having an orbiting frame carrying a type block, ribbon unwinding and winding reels, guide rolls for directing a run of ribbon over the type block, and a single drive input rotatable in clockwise and counterclockwise directions to orbit said frame in opposite directions, a ribbon feed mechanism for pulling ribbon from the unwinding reel, means driven from said drive input driving said feed mechanism, and adjustable means between said means driven by said drive input and said feed mechanism moving the feed mechanism in one direction only and for varying said movement to pull from the unwinding reel just enough length of ribbon to cover the type block with fresh ribbon after each imprint, said adjustable means including a driven rotating wheel having an elongated slot in an axial end face thereof diametrically thereof extending to both sides of a center point of the wheel, a block in said slot slidable along the length thereof, means affixing the block at a selected position in the slot on both sides of said center point, and a link connection between said block and said feed mechanism having a single direction drive stroke controlled by the position of said block in said slot whereby the orbital frame may be driven in opposite directions without changing the direction of drive input to the feed mechanism.

5. The imprinter of claim 4, wherein the block in the slot of the driven rotating wheel has a longitudinal slot and the means affixing said block at a selected position in the slot of said wheel extends through the slot of said block and clamps said block to said wheel.

6. The imprinter of claim 5, wherein the means affixing said block in the slot of the driven rotating wheel at a selected position in the slot is a pin and the slot in said driven rotating wheel has a plurality of longitudinally spaced threaded holes receiving said pin to clamp said block to the driven rotating wheel.

7. In a continuous motion imprinter of the type having an orbiting printing block and ribbon reel frame with guide rolls directing a run of the ribbon across the printing block and an input drive moving the frame in its orbital path to present the printing block and ribbon to the moving web material for advancing with the web to imprint indicia from the printing block on the web and to raise from the web during a return stroke, the improvement which comprises a feed roll mechanism having a nip pulling ribbon from the unwinding reel on the frame, a one way clutch in said feed roll mechanism, a drive linkage rotating said feed roll in successive strokes to pull a length increment of ribbon through the nip determined by the length of the stroke, means driven by the input drive to the orbiting frame driving said linkage, and means in the linkage selectively adjustable to vary the stroke thereof so that just enough length of ribbon is pulled from the unwinding reel to cover the type block with fresh ribbon after each imprint, the feed mechanism and adjusting means including a reversible drive wheel with a transverse slot in an outer face thereof extending in both directions from the center of the drive wheel, a block slidable in said slot toward and away from both sides of the center of the wheel, a link pivoted on said block, a clutch, an arm reciprocated by said link rotating said clutch in one direction in an amount determined by the stroke of the link, a feed roll driven by said clutch, a back-up roll biased against said feed roll defining a ribbon receiving nip, and locking means securing the block to position said link pivot at a selected distance from either side of the center of the drive wheel to control the stroke of the link and the degree of rotation of the clutch and feed roll for determining the length of the increment of ribbon pulled from the unwinding reel during each stroke of the link regardless of the direction of rotation of the drive wheel.

8. The imprinter of claim 7, wherein the link is pivoted on one end of said block slidable in said slot, the opposite end of said block has an elongated slot therein, and said locking means is a headed pin extending through said slot in said block and threaded into the transverse slot of the drive wheel clamping said block to the drive wheel.

9. The imprinter of claim 8, wherein the transverse slot of the drive wheel has a plurality of longitudinally spaced threaded holes selectively receiving said pin to increase the range of selected distances for the link pivot.

* * * * *